US010665403B2

(12) United States Patent
Rival et al.

(10) Patent No.: US 10,665,403 B2
(45) Date of Patent: May 26, 2020

(54) LOW-VOLTAGE MULTIPOLAR CIRCUIT BREAKER

(71) Applicant: Schneider Electric Industries SAS, Rueil Malmaison (FR)

(72) Inventors: Marc Rival, Bernin (FR); Cyril Domenech, Proveyssieux (FR); Daniel Rota, Vif (FR); Claude Todeschini, Sassenage (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 3 days.

(21) Appl. No.: 16/180,312

(22) Filed: Nov. 5, 2018

(65) Prior Publication Data

US 2019/0157028 A1 May 23, 2019

(30) Foreign Application Priority Data

Nov. 23, 2017 (FR) ..... 17 61100

(51) Int. Cl.
*H01H 9/34* (2006.01)
*H01H 33/02* (2006.01)
(Continued)

(52) U.S. Cl.
CPC ..... *H01H 33/53* (2013.01); *H01H 9/342* (2013.01); *H01H 9/346* (2013.01); *H01H 33/74* (2013.01);
(Continued)

(58) Field of Classification Search
CPC ..... H01H 9/3242; H01H 9/346; H01H 33/53; H01H 73/18
(Continued)

(56) References Cited

U.S. PATENT DOCUMENTS 3,676,623 A * 7/1972 Hollister ..... H01H 1/58 200/293
4,860,162 A * 8/1989 DeVizzi ..... H01H 71/0257 361/673
(Continued)

FOREIGN PATENT DOCUMENTS

| | | |
|---|---|---|
| EP | 0 437 151 A1 | 7/1991 |
| EP | 2 469 564 A1 | 6/2012 |
| WO | WO 02/03411 A1 | 1/2002 |

OTHER PUBLICATIONS

French Preliminary Search Report dated Jun. 14, 2018 in French Application 17 61100 filed on Nov. 23, 2017 (with English Translation of Categories of Cited Documents and Written Opinion).

*Primary Examiner* — William A Bolton
(74) *Attorney, Agent, or Firm* — Oblon, McClelland, Maier & Neustadt, L.L.P.

(57) ABSTRACT

A low-voltage multipolar circuit breaker includes a moulded housing including a main body that is divided into interior compartments, each associated with one pole of the circuit breaker, and a cover that is mounted on the main body covering a main face of the body. The circuit breaker includes, for each pole, electrical contacts that can be separated by a device of a switching mechanism and an arc-extinguishing chamber. For at least two of the poles, the main face includes an additional aperture, each placed directly above the spark guard of the corresponding pole and placing the arc-extinguishing chamber of this pole in communication with the interior volume delimited by the cover and the main face, and the cover is attached to the main body while leaving a peripheral opening between the cover and the main body, placing the interior volume in communication with the exterior of the housing.

10 Claims, 3 Drawing Sheets

(51) Int. Cl.
*H01H 33/08* (2006.01)
*H01H 33/53* (2006.01)
*H01H 33/74* (2006.01)

(52) U.S. Cl.
CPC ..... *H01H 33/022* (2013.01); *H01H 33/08* (2013.01); *H01H 2009/348* (2013.01); *H01H 2213/004* (2013.01)

(58) Field of Classification Search
USPC .... 218/155, 34, 35, 36, 38, 41, 47, 51, 156, 218/157, 26; 200/400
See application file for complete search history.

(56) References Cited

U.S. PATENT DOCUMENTS 5,731,561 A * 3/1998 Manthe ..... H01H 9/34 218/157
6,373,016 B2 * 4/2002 Brouillat ..... H01H 9/302 218/154
6,784,393 B2 * 8/2004 Bach ..... H01H 9/342 218/153
7,285,742 B2 * 10/2007 Kinzler ..... H01H 71/0207 218/149
7,674,996 B2 * 3/2010 Shea ..... H01H 9/302 218/149
7,988,915 B2 * 8/2011 Lee ..... B01L 3/502738 422/500
2003/0168433 A1 9/2003 Kurzmann
2012/0139672 A1 6/2012 Takaya et al.
2013/0140275 A1 * 6/2013 Shea ..... H01H 9/342 218/149
2015/0136740 A1 * 5/2015 Afshari ..... H01H 33/08 218/149
2017/0278653 A1 * 9/2017 Rival ..... B01D 46/0032

* cited by examiner

LOW-VOLTAGE MULTIPOLAR CIRCUIT BREAKER

The present invention relates to a low-voltage multipolar circuit breaker.

Low-voltage multipolar circuit breakers are known, comprising a moulded housing divided into interior compartments, each associated with one pole of the circuit breaker and each enclosing separable electrical contacts, the displacement of which is controlled by an actuation mechanism common to all the poles and driven by a trip mechanism.

One example of such a circuit breaker is described in FR-2780549-A1.

These circuit breakers are more particularly intended to be used to interrupt currents of high intensity, generally lying between 630 A and 6300 A. The breaking of the current is done in air, by separation of the electrical contacts, using an electrical arc-extinguishing chamber associated with each pole.

One known problem with these circuit breakers stems from the fact that hot and ionized gases, called extinguishing gases, are generated in the breaking of the current. These extinguishing gases exhibit a high temperature, typically greater than 2000° C., and a high pressure. They have to be discharged out of the circuit breaker, having been previously depolluted and cooled.

To remedy this, the known circuit breakers include extinguishing gas filtering devices.

These circuit breakers do not however give full satisfaction in some contemporary uses, particularly when these circuit breakers are intended to operate under high electrical voltages, for example for low voltages greater than or equal to 500 V AC and possibly ranging up to 690 V AC for each phase.

In particular, these circuit breakers then exhibit a greater risk of being damaged following an excessive overpressure of extinguishing gas inside the housing of the circuit breaker.

It is these drawbacks that the invention sets out more particularly to remedy by proposing a low-voltage multipolar circuit breaker in which the discharging of the extinguishing gases is optimized without degrading the performance levels of the circuit breaker.

To this end, the invention relates to a low-voltage multipolar circuit breaker, including a moulded housing including a main body and a cover, the cover being mounted on the main body and covering a main face of the main body, the main body being divided into interior compartments, each associated with one pole of the circuit breaker;

the circuit breaker further including, for each pole, inside the corresponding compartment:

- electrical contacts that can be separated by a switching mechanism of the circuit breaker;
- an arc-extinguishing chamber comprising: a stack of arc-separation plates, a spark guard which tops the stack, and an extinguishing gas outlet aperture, provided with a filtering device;

the circuit breaker being characterized in that, for at least two of the poles, the main face of the main body includes an additional aperture, each additional aperture being placed directly above the spark guard of the corresponding pole and placing the arc-extinguishing chamber of this pole in communication with the interior volume delimited by the cover and the main face, and in that the cover is attached to the main body while leaving a peripheral opening between the cover and the main body over the perimeter of the cover, this opening placing the interior volume in communication with the exterior of the housing.

By virtue of the invention, the additional apertures and the peripheral opening make it possible to provide an exhaust channel for extinguishing gases in the event of a significant overpressure, so as to avoid destruction of the circuit breaker, while limiting the quantity of extinguishing gas which does not pass through the filtering device. The discharging and the processing of the extinguishing gases are therefore optimized, without degrading the performance levels of the circuit breaker.

According to aspects of the invention that are advantageous but not mandatory, such a circuit breaker can incorporate one or more of the following features, taken alone or in any technically admissible combination:

- the peripheral opening has a separation of between 0.3 mm and 1 mm.
- the filtering device comprises a gas diffuser, a metal filter and an insulating screen made of synthetic fibres, inserted between the gas diffuser and the filter, the screen being provided with through-holes formed in a top part and in a bottom part of the screen.
- the screen also comprises a central cut-out.
- the arc-extinguishing chamber comprises baffles made of insulating material including synthetic fibres, installed vertically on either side of the inlet of the arc-extinguishing chamber.
- each additional aperture has an oblong form.
- the cover comprises a flange provided with bearing elements dimensioned to keep the separation of the peripheral opening constant over the periphery of the cover when the cover is mounted on the main body of the housing.
- the main body is made of thermoset polyester and the cover is made of polycarbonate.
- the interior compartments associated with the poles are aligned side by side within the main body, the two compartments adjacent to the pole situated at the centre of the alignment each being provided with one of said additional apertures, the other compartment or compartments situated between the two lateral compartments having no additional aperture.
- the circuit breaker is a triple-pole circuit breaker, the compartment situated at the centre of the alignment having no additional aperture.

The invention will be better understood and other advantages thereof will become more clearly apparent in light of the following description, of an embodiment of a low-voltage circuit breaker, given purely as an example and with reference to the attached drawings in which.

FIGS. 1 to 4 represent a low-voltage multipolar circuit breaker 2 comprising a moulded housing including a main body 4 and a removable cover 6 added to the main body 4.

When the cover 6 is mounted on the main body 4, it covers a main face 22 of the main body 4. For example, the main face 22 is a front face of the main body 4.

Figure 1:
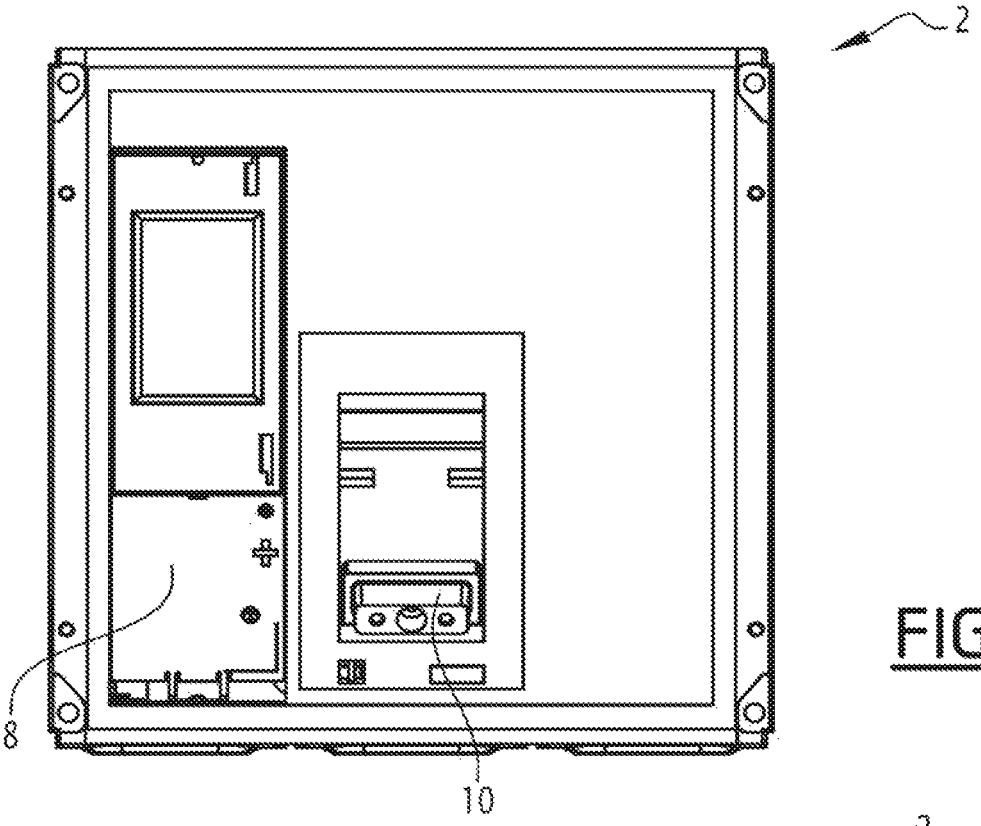
FIG. 1 is a schematic illustration, by a front view, of an example of a low-voltage circuit breaker according to the invention.
Figure 2:
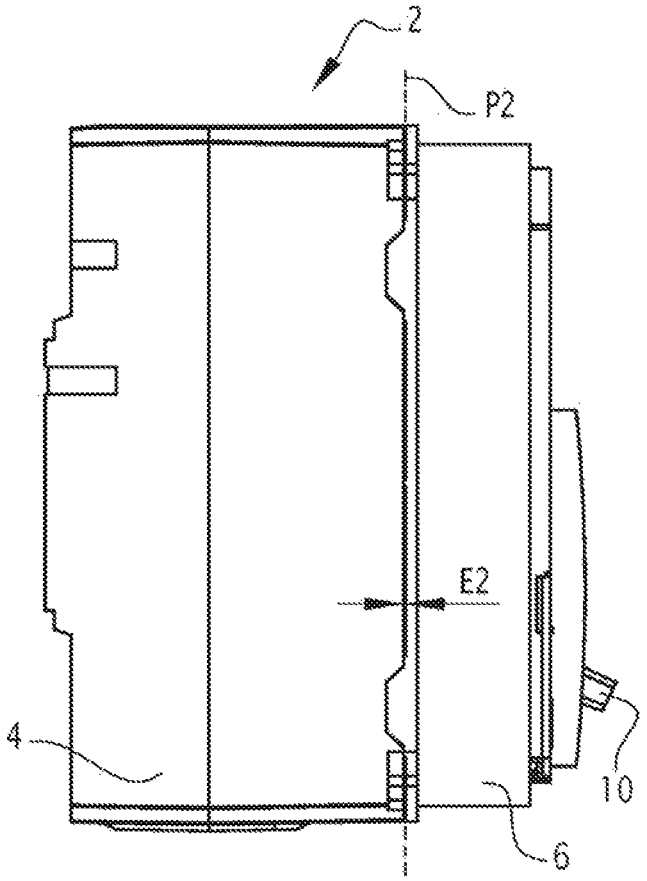
FIG. 2 is a schematic illustration, by a side view, of the circuit breaker of FIG. 1.

As emerges more particularly from FIG. 2, the cover 6 is fastened to the main body 4 while leaving a peripheral opening between the cover 6 and the main body 4. This peripheral opening extends over the perimeter of the cover 6.

The cover 6 defines, with the face 22, an interior volume. The peripheral opening places this interior volume in communication with the exterior of the housing of the circuit breaker 2.

The reference "P2" denotes a geometrical plane at the level of which the join between the cover 6 and the main body 4 is produced.

Preferably, the peripheral opening has a separation, denoted E2, of between 0.3 mm and 1 mm and, more preferentially, of between 0.5 mm and 0.7 mm and, even more preferably, equal to 0.6 mm. This separation E2 is, here, measured in a direction at right angles to the main face 22.

For example, the main body 4 is made of thermoset polyester and the cover 6 is made of polycarbonate.

The circuit breaker 2 also comprises a switching mechanism.

In this example, the circuit breaker 2 also comprises a trip 8 and a manual control lever 10, capable of controlling the switching mechanism. The trip 8 and the control lever 10 are arranged at the front of the circuit breaker 2 so as to be accessible by a user of the circuit breaker 2.

The circuit breaker 2 comprises several electrical poles, here each associated with an electrical phase of an electrical installation to which the circuit breaker 2 is connected.

According to embodiments, the circuit breaker 2 is a triple-pole circuit breaker intended to operate with a three-phase electrical installation. The circuit breaker 2 to this end comprises three electrical poles, each associated with one of the three electrical phases.

In alternative embodiments not illustrated, the circuit breaker 2 is a four-pole circuit breaker, intended to operate with a three-phase electrical installation provided with a neutral line. The circuit breaker 2 then comprises four poles, respectively associated with the electrical phases and with the neutral line.

"Low voltage" is understood to mean that the circuit breaker 2 is capable of operating under electrical voltages ranging up to 690 V AC for each pole.

The circuit breaker 2 is capable of interrupting nominal currents of an intensity of between 630 A and 6300 A.

The main body 4 of the housing of the circuit breaker 2 is divided into interior compartments, each associated with one pole of the circuit breaker 2. These compartments are also called "pole compartments" hereinbelow.

Hereinbelow, to simplify the description, the reference symbols 12, 14 and 16 are used without distinction to denote the electrical poles of the circuit breaker 2 or else the corresponding interior compartments.

For example, the compartments 12, 14 and 16 are aligned laterally side-by-side on a transverse axis of the main body 4. The compartment 14 is in the central position of this alignment. The compartments 12 and 16 are placed in lateral positions on either side of the central compartment 14. The compartments 12, 14 and 16 are separated in pairs by internal partitions.

The main face 22 of the main body 4 also comprises an additional aperture 18, 20 for at least two of the poles. The role of these additional apertures 18, 20 is described in more detail hereinbelow.

For example, each additional aperture 18, 20 has an oblong form.

According to implementations, the surface area of each additional aperture 18, 20 lies between 0.5 $cm^2$ and 2 $cm^2$ and, preferably, is equal to 1 $cm^2$.

Figure 3:
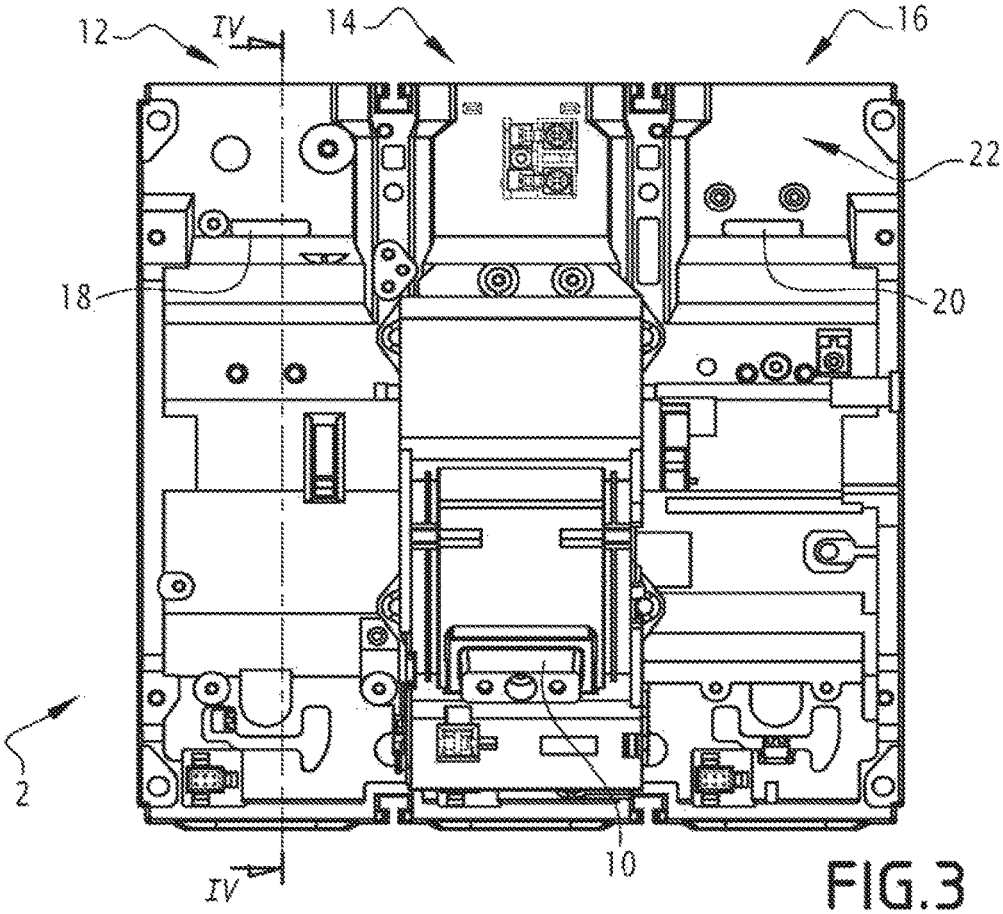
FIG. 3 is a schematic illustration, by a front view, of the circuit breaker of FIG. 1, in which a cover of the circuit breaker is removed.

According to embodiments, as illustrated in FIG. 3, the circuit breaker 2 comprises a first additional aperture 18, associated with the compartment 12, and a second additional aperture 20, associated with the compartment 16. The central compartment 14 has no additional aperture.

Figure 4:
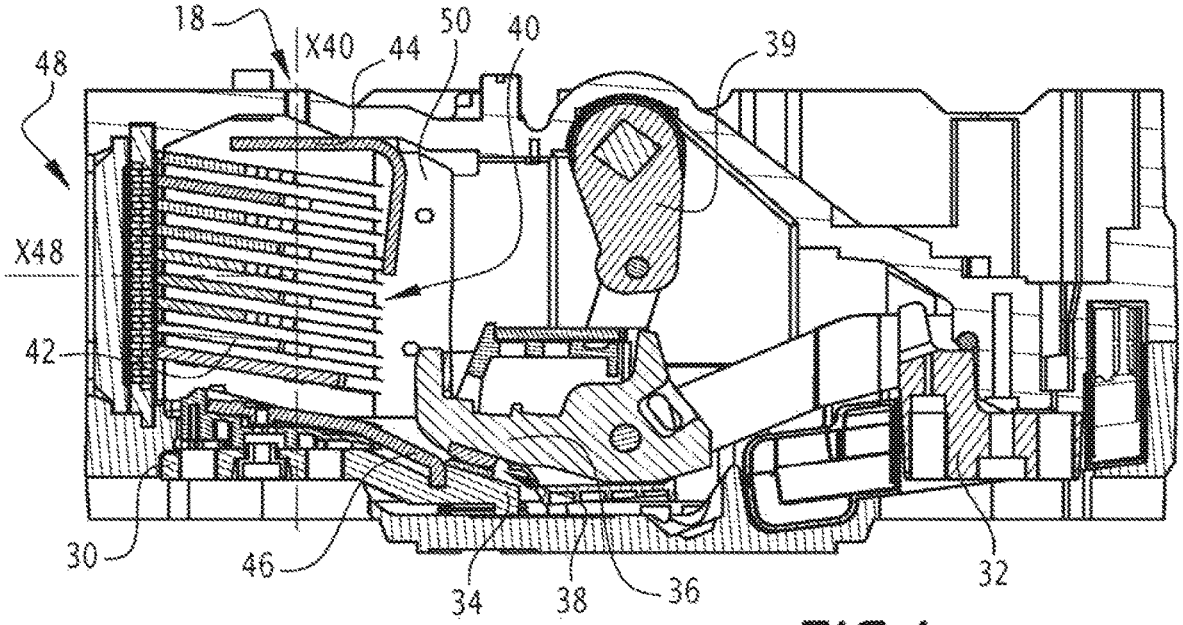
FIG. 4 is a schematic illustration, by a lateral cross-sectional view in the plane IV-IV of FIG. 3, schematically showing the interior of the circuit breaker for an electrical pole.

As illustrated in FIG. 4, the circuit breaker 2 comprises, for each pole, electrical connection terminals 30, 32 and separable electrical contacts, such as a fixed electrical contact 34 associated with a mobile electrical contact 36, each connected to a terminal 30, 32. The contacts 34 and 36 have no electrical contact pads 38.

The control mechanism is common to all the poles and is designed to open or close the electrical circuit formed by these contacts 34 and 36, in particular using a rotary shaft 39 configured to move the mobile contact 36. That makes it possible to respectively prevent or, alternately, authorize, the circulation of an electrical current between the terminals 30 and 32 for each pole.

The shaft 39 is common to the poles of the circuit breaker 2 and extends in the main body 4 in a transverse direction of the circuit breaker 2. In particular, the internal partitions separating the compartments 12, 14 and 16 are provided with openings allowing the passage of the shaft 39. These openings do not however allow fluidic communication between neighbouring compartments.

The circuit breaker 2 further comprises, for each pole, an arc-extinguishing chamber 40. The arc-extinguishing chamber 40 comprises a stack 42 of arc-separation plates, a spark guard 44, a bottom arc horn 46 and an extinguishing gas outlet aperture, called main aperture, provided with a filtering device 48. The main aperture emerges outside of the main body 4 and therefore outside of the circuit breaker 2.

The operation of the arc-extinguishing chambers is well known and is not explained in more detail. An example of arc-extinguishing chamber is described in the patent EP-1764811-B1.

The geometrical axis X40 denotes a direction of alignment of the plates of the stack 42. The spark guard 44 tops the stack 42, being aligned with this stack on the axis X40. For example, the spark guard 44 takes the form of a bent solid plate, here bent at a right angle so that its cross section is L-shaped.

The additional aperture 18 is formed in the main face 22 directly above the spark guard 44. In other words, the spark guard 44 is inserted between the additional aperture 18 and the stack 42. The additional aperture 18 is, here, aligned with the spark guard 44 on the axis X40.

In the example illustrated, the reference X48 denotes a geometrical axis passing through the main extinguishing gas outlet aperture. The axis X48 is at right angles to the axis X40.

The arc-extinguishing chamber 40 is arranged in such a way that the greater portion of the extinguishing gas is discharged out of the compartment 12 by passing through the filtering device 48. The extinguishing gas flow is therefore essentially oriented along the axis X48 when it is discharged out of the compartment 12.

It is therefore only in the event of a significant overpressure that the extinguishing gases pass through the additional aperture 18 in addition to passing through the filtering device 48, because the additional aperture 18 is set apart from the trajectory followed by the main extinguishing gas flow.

That is due in particular to the fact that the axes X40 and X48 are misaligned, and more particularly at right angles. That is also due to the fact that the spark guard 44 is inserted between the stack 42 and the additional aperture 18, so as to form a screen preventing the passage of the gases directly in a straight line from the arc-extinguishing chamber 40.

The other poles of the circuit breaker 2 have a similar design. In particular, the pole 16 is similar to the pole 12, apart from the fact that the additional aperture of the pole 16 bears the reference 20. The pole 14, situated between the poles 12 and 16, is similar to the pole 12, apart from the fact that it includes no additional aperture 18 or 20.

The additional apertures 18 and 20, acting jointly with the peripheral opening between the cover 6 and the main body 4, thus allow a decompression of the arc-extinguishing chamber 40 of the poles 12 and 16 at the moment of the pressure spike which occurs upon the breaking of the current, by forming an additional outlet for the extinguishing gases.

The arrangement of the additional apertures 18 and 20 makes it possible to limit the quantity of extinguishing gas which is rejected on the occurrence of such a decompression. Indeed, it is not desirable to reject too much unpolluted and uncooled extinguishing gas outside of the circuit breaker 2, because that could have damaging consequences for the safety of goods and personnel.

In particular, the use of just two additional apertures 18, 20 is, here, advantageous. In the present case, it is not necessary to place an additional aperture on the central compartment associated with the pole 14, because this compartment is connected fluidically with the interior volume delimited by the cover 6 via the opening in which the mechanism is installed, such that the overpressure of extinguishing gas generated for this central compartment 14 can be discharged.

The limiting of the number of additional apertures makes it possible to limit the quantity of extinguishing gas which is rejected on the occurrence of such a decompression.

In the normal operation of the circuit breaker 2, the cover 6 is mounted on the main body 4. In fact, the extinguishing gas outgoing through the additional apertures 18 and 20 has to run inside the cover 6, in the interior volume, before being able to exit from the circuit breaker 2. This arrangement attenuates the pressure wave formed upon the ejection of the extinguishing gases, and limits the loss of seal-tightness of the circuit breaker 2 occasioned by the presence of the additional apertures 18 and 20, in particular the tightness to water and to dust.

Finally, the values previously defined for the separation E2 make it possible to ensure a satisfactory discharging of the overpressure, without in any way degrading the sealing properties of the circuit breaker, in particular the tightness to water and to dust.

Thus, the invention makes it possible to limit the risk of damage to the circuit breaker 2 following an overpressure, without degrading the performance levels of the circuit breaker 2.

According to alternative implementations, in the case of a four-pole circuit breaker, it is possible to use only two such additional apertures 18, 20, formed for the pole compartments adjacent to the pole situated at the centre of the alignment, that is to say situated on the lateral edges on either side of the central pole.

According to a variant, in the case of a four-pole circuit breaker for a three-phase installation with neutral line, it is not necessary to form an additional aperture for the pole compartment associated with the neutral line, because the energy involved in the breaking of the current for this neutral line is less than that for the breaking on an electrical phase, and therefore the risk of extinguishing gas overpressure in this pole compartment is lesser.

According to additional implementations, the arc-extinguishing chamber 40 also includes vertical baffles 50 made of a material including synthetic fibres, for example of aramid type. Preferably, the baffles 50 are produced in the material known by the trademark Nomex® and marketed by the company DU PONT DE NEMOURS.

For example, the baffles 50 are installed vertically on either side of the inlet of the arc-extinguishing chamber 40, extending parallel to the axis X40. The baffles 50 take the form of an elongate strip and are fixed to lateral walls of the arc-extinguishing chamber 40. Here, there are two baffles 50.

The baffles 50 channel the electrical arc in the arc-extinguishing chamber 40 and minimize the returns of extinguishing gas laterally at the periphery of the arc-extinguishing chamber. The baffles 50 therefore contribute to further optimizing the discharging and the processing of the arc-extinguishing gases of the circuit breaker 2.

Figure 5:
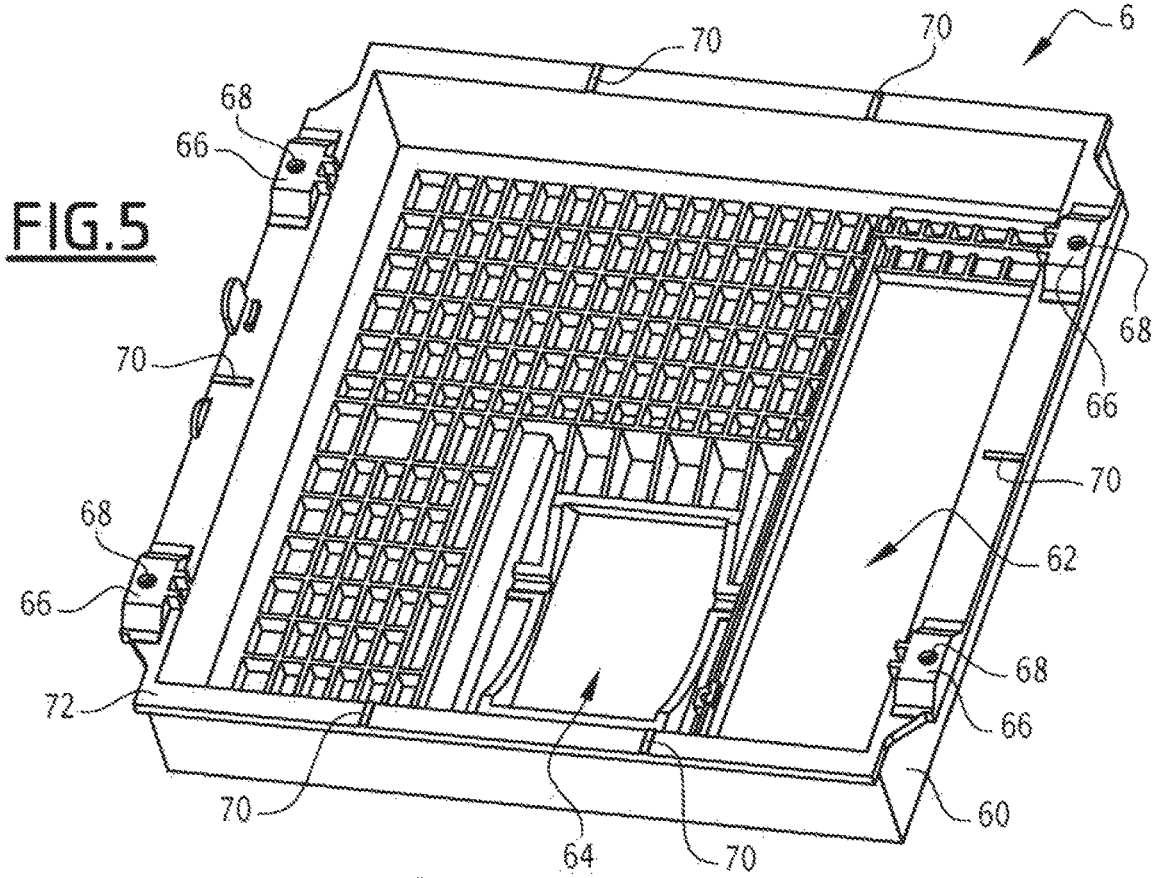
FIG. 5 is a schematic illustration of the interior of the cover of the circuit breaker of FIG. 1.

FIG. 5 represents an embodiment of the cover 6.

This cover 6 comprises a main part 60, here in the form of a hollow block whose base is a regular quadrilateral. The main part 60 comprises a front-end wall which forms a front face of the circuit breaker 2 when the cover 6 is mounted on the main body 4. For example, the front-end wall includes through-windows 62 and 64 respectively allowing the passage of the trip 8 and of the control lever 10.

The main part 60 thus delimits a cavity which emerges outside of the cover 6 on the back of the cover. The form and the dimensions of the main part 60 are chosen according to the form of the main body 4.

The cover 6 also includes fastening elements 66 intended to allow the cover 6 to be fastened onto the main body 4, preferably a fastening with no degree of freedom. The main body 4 also includes elements complementing the fastening elements 66, for example in the form of cutouts or hollows designed to receive the fastening elements. The fastening elements 66 are, for example, each provided with a hole 68 to receive a screw, the screwing of which is done here in the main body 4.

The cover 6 also includes a flange 72 formed at the base of the main part 60. This flange 72 has a flat form and extends over all the perimeter of the base of the main part 60.

The flange 72 is provided with bearing elements 70, or spacers, which are dimensioned to maintain the separation E2 of the peripheral opening when the cover 6 is mounted on the main body 4. These bearing elements 70 are thus intended to come into contact with a corresponding surface of the main body 4 when the cover 6 is mounted on the main body 4. The bearing elements 70 are, here, tabs formed of a single piece with the rest of the cover 6.

The fastening elements 66 are, here, formed projecting on the flange 72. They also come to bear on the central body 4 when the cover 6 is fastened, and therefore form bearing elements which act jointly with the bearing elements 70.

Figure 6:
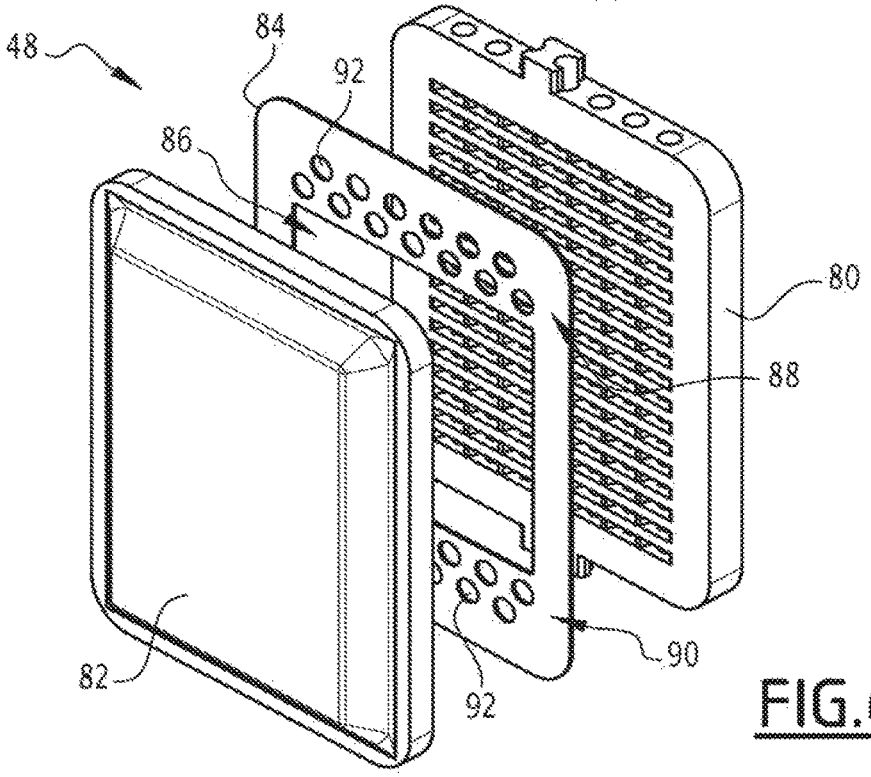
FIG. 6 is a schematic illustration, by an exploded view, of an extinguishing gas filtering device of the circuit breaker of FIG. 1.

FIG. 6 illustrates a preferential embodiment of the filtering device 48.

The filtering device 48 comprises a gas diffuser 80, a metal filter 82 and an insulating screen 84 inserted between the gas diffuser 80 and the filter 82. The diffuser 80, the filter 82 and the screen 84 are, here, aligned along the axis X48.

The diffuser 80, the filter 82 and the screen 84 are, here, illustrated separated from one another. However, in practice, when the filtering device 48 is in an assembled configuration, the diffuser 80, the filter 82 and the screen 84 are in contact two-by-two.

The gas diffuser 80 forms an inlet of the filtering device 48 and its function is to spatially distribute the extinguishing gas flow, so that, at the outlet of the diffuser 80, the extinguishing gas is distributed uniformly over all the surface of the filter 82. An example of the gas diffuser 80 is described in EP-1251530-A1.

The function of the filter 82 is to cool and depollute the extinguishing gas. It comprises a stack of metal fabrics of "repp" type. An example of the filter 82 is described in the patent EP-0817223-B1.

The screen 84 comprises a layer of electrically insulating material made of synthetic fibres, for example of aramid type. Preferably, the screen 84 is produced in the material under the trademark Nomex® and marketed by the company DU PONT DE NEMOURS.

According to implementations, the screen 84 advantageously has a central cut-out 86. This central cut-out 86 extends to a top part 88 and to a bottom part 90 of the screen 84.

Preferably, the top part 88 and the bottom part 90 are provided with through-holes 92 allowing the passage of the extinguishing gas. The holes 92 are for example formed by cutting.

As a variant, the central cut-out 86 is omitted and replaced by through-holes similar to the holes 92.

The top 88 and bottom 90 parts thus pierced with holes 92 allow the passage of the extinguishing gas while providing reinforced electrical insulation. The risk of loopback of the current in the ionized extinguishing gas at the metal filter 82 is thus reduced.

The central cut-out 86 makes it possible to avoid excessively restricting the flow of the extinguishing gas. The absence of holes 92 in the central part of the screen 84 is not prejudicial, because it is primarily in the bottom 88 and top 90 parts that the risk of loopback of the current is highest.

Thus, the efficiency of the filtering device 48 is enhanced, without in any way increasing the level of ionization outside of the circuit breaker 2, in particular with respect to live electrical conductors located in the immediate environment of the circuit breaker 2 while it is in operation.

In other words, the filtering device 48 contributes to further optimizing the discharging and the processing of the extinguishing gases from the circuit breaker 2.

The embodiments and the variants considered above can be combined with one another to generate new embodiments.

The invention claimed is:

1. A low-voltage multipolar circuit breaker, comprising a moulded housing including a main body and a cover, the cover being mounted on the main body and covering a main face of the main body, the main body being divided into interior compartments, each associated with one pole of the circuit breaker;

the circuit breaker further comprising, for each pole, inside a corresponding compartment:

electrical contacts that can be separated with a switching mechanism of the circuit breaker;

an arc-extinguishing chamber comprising: a stack of arc-separation plates, a spark guard which tops the stack, and an extinguishing gas outlet aperture, provided with a filtering device;

the circuit breaker, wherein for at least two of the poles, the main face of the main body includes an additional aperture placed directly above the spark guard of a corresponding pole of the at least two poles and placing the arc-extinguishing chamber of the corresponding pole in fluid communication with an interior volume formed between the cover and the main face, and wherein the cover is attached to the main body while leaving a peripheral opening between the cover and the main body over an entire perimeter of the cover, the peripheral opening placing the interior volume in fluid communication with an exterior of the housing.

2. The circuit breaker according to claim 1, wherein the peripheral opening has a separation of between 0.3 mm and 1 mm.

3. The circuit breaker according to claim 1, wherein the filtering device comprises a gas diffuser, a metal filter and an insulating screen made of synthetic fibres, inserted between the gas diffuser and the filter, the screen being provided with through-holes formed in a top part and in a bottom part of the screen.

4. The circuit breaker according to claim 3, wherein the screen also comprises a central cut-out.

5. The circuit breaker according to claim 1, wherein the arc-extinguishing chamber includes baffles made of insulating material including synthetic fibres, installed vertically on either side of an inlet of the arc-extinguishing chamber.

6. The circuit breaker according to claim 1, wherein each additional aperture has an oblong form.

7. The circuit breaker according to claim 1, wherein the cover includes a flange provided with bearing elements dimensioned to keep a separation of the peripheral opening constant over a periphery of the cover when the cover is mounted on the main body of the housing.

8. The circuit breaker according to claim 1, wherein the main body is made of thermoset polyester and the cover is made of polycarbonate.

9. The circuit breaker according to claim 1, wherein the interior compartments associated with the poles are aligned side by side within the main body, the two compartments adjacent to the pole situated at a center of an alignment each being provided with one said additional apertures, an other compartment or compartments situated between the two adjacent compartments having no additional aperture.

10. The circuit breaker according to claim 9, wherein the circuit breaker is a triple-pole circuit breaker, the compartment situated at the centre of the alignment having no additional aperture.

* * * * *